US006048295A

United States Patent [19]

Olsén

[11] Patent Number: 6,048,295

[45] Date of Patent: Apr. 11, 2000

[54] METHOD IN THE FORMING OF PACKAGING CONTAINERS

[75] Inventor: Jan-Erik Olsén, Ystad, Sweden

[73] Assignee: Tetra Laval Holdings & Finance S.A., Pully, Switzerland

[21] Appl. No.: 09/107,274

[22] Filed: Jun. 30, 1998

[30] Foreign Application Priority Data

Aug. 14, 1997 [SE] Sweden ..... 9702936

[51] Int. Cl.[7] ..... B31B 1/50; B31B 1/64; B31B 1/00

[52] U.S. Cl. ..... 493/184; 493/183; 493/460; 493/465; 493/133

[58] Field of Search ..... 493/133, 183, 493/184, 185, 175, 176, 165, 465, 460, 960

[56] References Cited

U.S. PATENT DOCUMENTS

| | | | |
|---|---|---|---|
| 1,845,895 | 2/1932 | Voorhis | 493/458 |
| 3,795,359 | 3/1974 | Rausing | 229/7 R |
| 3,979,048 | 9/1976 | Stark et al. | 229/48 T |
| 4,331,288 | 5/1982 | Löthman | 229/17 R |
| 4,795,086 | 1/1989 | Farber | 493/183 |
| 4,804,356 | 2/1989 | Yoshida et al. | 493/133 |
| 5,143,281 | 9/1992 | Mainz et al. | 493/133 |

FOREIGN PATENT DOCUMENTS 0 667 284 A1 8/1995 European Pat. Off. .

*Primary Examiner*—Peter Vo
*Assistant Examiner*—Matthew Luby
*Attorney, Agent, or Firm*—Burns, Doane, Swecker & Mathis, L.L.P.

[57] ABSTRACT

The disclosure relates to a method in the forming of packaging containers (1) which have sealing fins in which the packaging material is sealed inside-to-inside, and also projecting, double-walled corner flaps (8). In order to form a parallelepipedic packaging container, the corner flaps are folded down and sealed to the outside of the packaging container, which subjects a sealing fin running between the corner flaps to stresses which may entail untightness in the packaging container. This is avoided in that the sealing fin, prior to the downward folding operation, is deformed in that at least a portion of the fin (4) is laterally displaced in relation to adjacent portions of the fin.

8 Claims, 2 Drawing Sheets

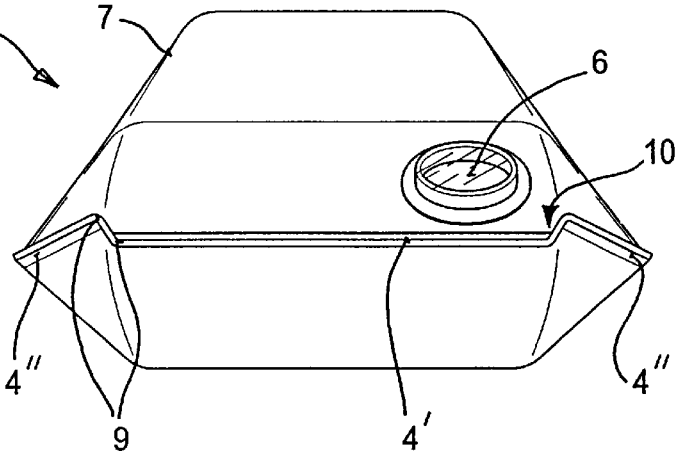
Fig 4
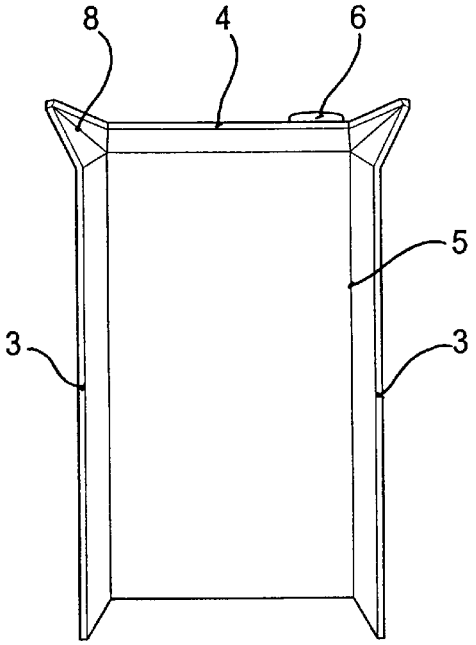
Fig 5
Fig 6
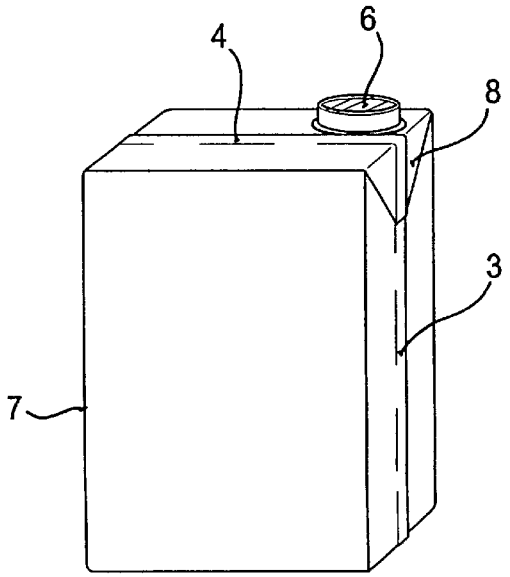

METHOD IN THE FORMING OF PACKAGING CONTAINERS

TECHNICAL FIELD

The present invention relates to a method in the forming of packaging containers which include a sealing fin in which the packaging material is sealed inside-to-inside, and also projecting, double-walled corner flaps which are flat-laid, folded down and sealed to the outside of the packaging container.

BACKGROUND ART

Consumer packages for liquid or pumpable foods, e.g. milk, wine, stewed fruits or the like are often produced from foldable packaging material, e.g. packaging laminates comprising layers of fibre material, aluminium foil and thermoplastic. The material is formed by folding, sealing and processing into packaging containers of the desired shape and size, which may either take place in connection with the filling operation proper or beforehand. In a prior art method described in Swedish Patent No. SE 502.182, the prefabrication takes place of flat-laid, ready-to-fill packaging containers, the forming and filling operations taking place simultaneously in a packing/filling machine which may be located at the producer of the intended contents. This method is also suitable for the production of packaging containers with long shelf-life, so-called aseptic packaging containers which may be produced in that both the packaging material and the product are sterilized prior to completion of the packages.

A common type of packaging container which is produced employing the above-outlined method is a substantially parallelepipedic packaging container which has been produced in that the packaging laminate, after cutting and sealing, is first given cushion-like form, and thereafter a final, substantially parallelepipedic configuration. In the final forming processing, four double-walled corner flaps occur which are formed from material which, for geometric reasons, cannot be utilized in the forming of the actual parallelepipedic container body. In order not to be in the way or disrupt the regular parallelepipedic shape, these flat-pressed corner flaps are folded in towards and sealed to adjacent packaging container surfaces.

The packaging container will, along a number of its wall surfaces, display projecting sealing fins in which the packaging laminate is sealed inside-to-inside. One of these sealing fins extends substantially centrally over the upper end wall of the packaging container and out over to the corner flaps defining this end wall. The sealing fin thus extends transversely over the end wall of the packaging container between the two free corners of the corner flaps connected with the end wall. In connection with reforming from cushion shape to substantially parallelepipedic configuration, the sealing fin is folded down so that it abuts against that material surface to which it is connected, at the same time as the flat-pressed corner flaps are folded in and connected to adjacent container walls. The two corner flaps located at the lower end of the packaging container are normally folded in towards the bottom end of the packaging container, while the corner flaps located at the upper end of the packaging container are folded in towards the side surfaces of the packaging container. During the reforming of the packaging container from planar form to cushion shape, these corner flaps will, however, also temporarily be folded upwards, i.e. in the longitudinal direction of the packaging container. On folding of the corner flaps in the longitudinal direction of the packaging container, i.e. out from the central region of the packaging container, a temporary "compression" is necessitated of the sealing fin extending between the corner flaps, since its original length must be reduced by folding and compressing of the sealing fin, which above all occurs at the transition from the corner flaps to the upper end surface of the packaging container. This deformation has proved to occasion difficulties, which is principally because the sealing fin (which clearly includes a plurality of packaging material layers) is relatively rigid and does not readily permit being bent or compressed. Even if it is, naturally, possible to carry out the bending and compression operations, crack formation and/or leakage readily occur in such instance, which is injurious not only to the tightness of the packaging container itself but also to the shelf-life of the packed product. The problem is particularly manifest in aseptic packaging containers, since the requirement of tightness also from the point of view of bacteria is particularly high, and since the packaging laminate normally includes layers of aluminium foil which has considerably poorer tensile properties than the included fibre and thermoplastic materials.

With a view to obviating the above-outlined problems, attempts have been made to increase the elasticity of the included materials as far as is possible, which has given improvements as regards the thermoplastic layers, but has not solved the problem involving any possible aluminium layers included in the laminate.

For the above-considered reasons, there is a need in the art to realize a forming method which, in the above-described type of packages, makes for reforming from cushion shape to parallelepipedic shape without the sealing fins of the packaging material being exposed to such stresses that risk of leakage or crack formation occur.

OBJECTS OF THE INVENTION

One object of the present invention is thus to realize a method in the forming of packaging containers which makes it possible to monitor and control the folding of the sealing fin in such a manner that the risk of damage is reduced.

A further object of the present invention is to realize a method in the forming of packaging containers which makes it possible to reform a cushion-shaped packaging container provided with sealing fins into substantially parallelepipedic configuration without the included sealing fins being exposed to such stresses that damage occurs.

Yet a further object of the present invention is to realize a method in the forming of packaging containers which makes it possible to control the deformation of the sealing fin in such a manner that damage does not occur.

Still a further object of the present invention is to realize a method in the forming of packaging containers which is applicable for utilisation in the modern, high speed manufacture of packaging containers without operational reliability suffering and without extra costs being excessively high.

SOLUTION

These and other objects have been attained according to the present invention in that a method, in the forming of packaging containers which include a sealing fin in which the packaging material is sealed inside-to-inside, and also projecting, double-walled corner flaps which are flat-laid, folded down and sealed to the outside of the packaging container, has been given the characterizing feature that a sealing fin which extends both over one side of the packaging container and over a corner flap prior to its folding down is deformed in that at least portion of the fin is displaced laterally in relation to adjacent portions of the sealing fin.

Preferred embodiments of the method according to the present invention have further been given the characterizing features as set forth in the appended subclaims.

By, in accordance with the present invention, deforming the sealing fin prior to raising of the packaging container to parallelepipedic configuration, the stresses occurring in the fin in connection with the reforming operation will be controlled and reduced to such a degree that the risk of crack formation and leakage is in practice obviated. The method is simple to apply in existing machines and, as a result, does not affect either operational costs or operational reliability to any appreciable extent.

BRIEF DESCRIPTION OF THE ACCOMPANYING DRAWINGS

One preferred embodiment of the method according to the present invention will now be described in greater detail hereinbelow, with reference to the accompanying, schematic Drawings which shows only those details essential to an understanding of the present invention. In the accompanying Drawings:

FIG. 4 shows the packaging container of FIG. 1 in one phase during the reforming of the packaging into parallelepipedic configuration;

FIG. 5 is a side elevation of the packaging container of FIG. 4; and

FIG. 6 is a perspective view of a finished packaging container.

DESCRIPTION OF PREFERRED EMBODIMENT

Figure 1:
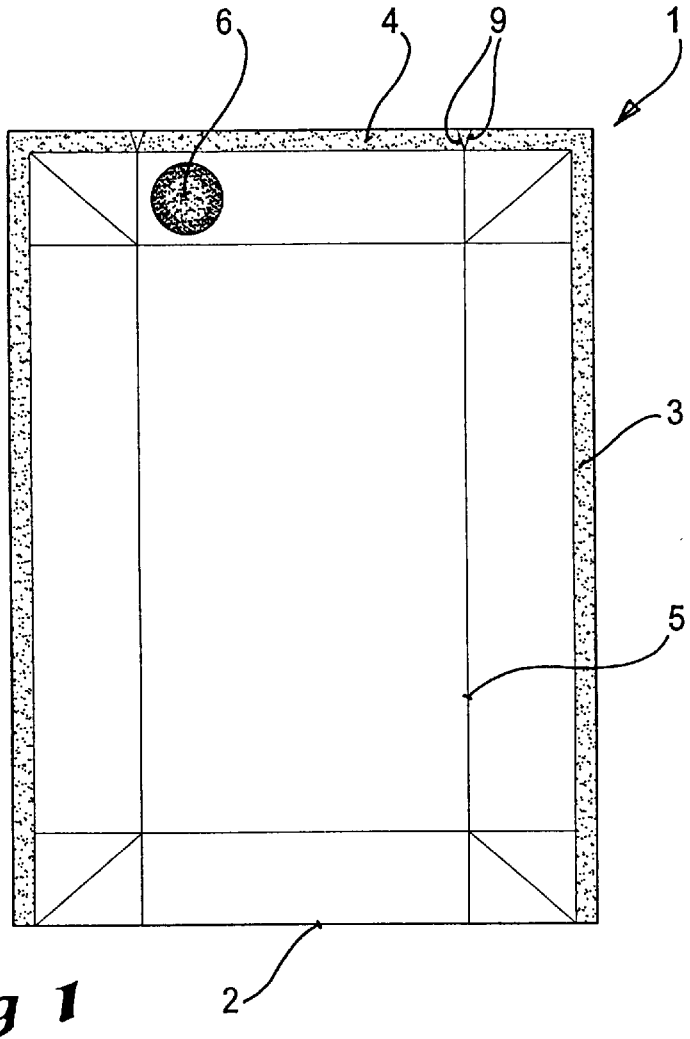
FIG. 1 shows, in the flat-laid state, a packaging container of the type which is intended to be handled employing the method according to the invention.

One preferred embodiment of a packaging container which is intended to be used in connection with the method according to the present invention is illustrated in FIG. 1 and consists of a foldable, flexible packaging material of per se known type. The packaging material is a laminate which includes a substantially central core or carrier layer of fibre material, for example paper, which is coated on either side with homogeneous layers of thermoplastic material, e.g. polyethylene. The polyethylene layers impart to the packaging material the desired liquid tightness and, moreover, make it possible to thermoseal the material. In those cases when reinforced light or gas barrier properties are desired, the packaging laminate also includes a layer of aluminium foil or other barrier material which is bonded to the fibre material by means of a further layer of thermoplastic. A packaging container of this type, together with the method of forming and filling the packaging container are described in greater detail in Swedish Patent No. SE 502.182, to which reference is now made for further details.

FIG. 1 shows the packaging container in the compressed or flat-laid state, which makes it suitable to be transported in a space-saving manner, for example from the site of manufacture to the food producer where the packaging container is to be completed and filled with the desired contents.

The packaging container 1 is produced in that a sheet of the packaging material is folded double along a bottom line 2, whereafter the longitudinal and transverse edges of the sheet are thermosealed inside-to-inside in two mutually parallel, longitudinal joints or sealing fins 3, and also a transverse sealing fin 4. The packaging material is also provided with a pattern of fold or crease lines 5 which make it possible in a per se known manner to convert the flat-laid blank into a substantially parallelepipedic packaging configuration, as will be described in greater detail below. At the upper end of the packaging container, the one side of the flat-laid blank displays an applied opening arrangement 6 which preferably consists of a projecting, tubular plastic portion which is covered with a cap or plastic film.

It will be apparent from FIG. 6 how the packaging container 1, after filling and sealing, has obtained its parallelepipedic configuration, the fold or crease lines 5 controlling the formation of the longitudinal and transverse edge lines 7 of the packaging container, and making possible the formation of four flat-laid corner flaps 8 for taking care of surplus material which, for geometric reasons, occur on the reforming of the flat-laid packaging container into its parallelepipedic final form. The two upper corner flaps 8 are folded down and sealed to the sides of the packaging container, while two bottom corner flaps (not visible) are folded in towards and thermosealed to the bottom of the packaging container. It will also be apparent from FIG. 6 how the opening arrangement, after reforming of the packaging container, is placed at the relatively planar, upper surface of the packaging container between one of the edge lines 7 and the transverse joint or sealing fin 4 running centrally over the upper surface of the packaging container.

Figure 2:
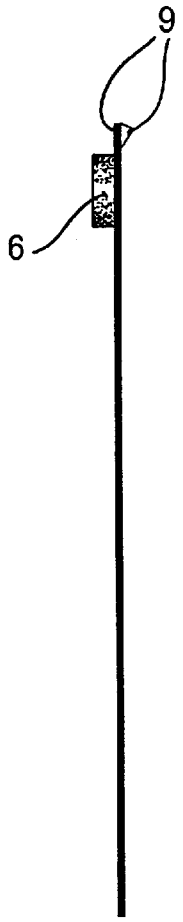
FIG. 2 is a side elevation of the packaging container of FIG. 1.
Figure 3:
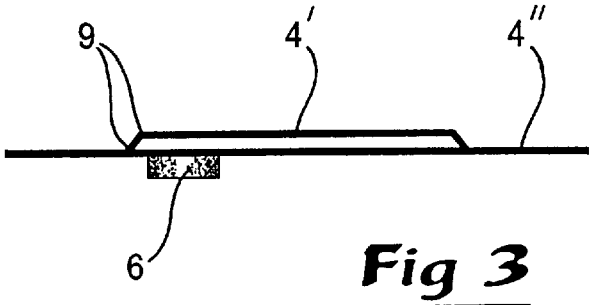
FIG. 3 is an end elevation of the packaging container of FIG. 1.

FIGS. 4 and 5 show how the packaging container 1, during the reforming from the flat-laid form shown in FIGS. 1–3, to the parallelepipedic form shown in FIG. 6, assumes a cushion-like form with partly projecting corner flaps and only partly defined edge lines. Of the four corner flaps 8 which are visible in FIG. 5, the two corner flaps 8 located at the lower end of the packaging container are folded downwards and subsequently inwards in order, in the finished, parallelepipedic packaging container, to be thermosealed to the bottom of the packaging container. The two upper corner flaps 8 are folded outwards/downwards in order, in the finished packaging container, to be sealed against the side surfaces of the packaging container. However, as is apparent from FIG. 5, all four corner flaps 8, when the packaging container is cushion shaped, will extend more or less in the longitudinal direction of the packaging container, i.e. away from the central region of the packaging container. At the upper end of the packaging container 1, the transverse sealing fin 4 extends, as was mentioned previously, transversely over the packaging container between the outer, free ends of the two corner flaps 8. This situation creates problems in connection with the folding of the corner flaps, since the distance between the outer ends of the corner flaps in the position illustrated in FIGS. 4 and 5 is less than the total length of the sealing fin, which entails that the sealing fin must be deformed or "buckled" during this phase of the forming process in order thereafter to be once again stretched when the corner flaps 8 are folded down towards and secured to the opposing sides of the packaging container. Since the sealing fin 4 is originally entirely straight and includes a plurality of material layers, it displays a considerable rigidity which, in practice, renders it impossible to achieve the necessary deformation without the sealing fin partly cracking and causing leakage. In order, in accordance with the present invention, to facilitate the deformation, the fin is subjected, while the packaging container blank is still in the planar state illustrated in FIGS. 1–3, to a plastic deformation in that, before the downward folding of the corner flaps, at least some portion of the fin is laterally displaced in relation to adjacent portions of the sealing fin. More precisely, according to one preferred embodiment of the method according to the present invention, a central portion 4' of the sealing fin 4 extending over the upper end surface of the packaging container will, by mechanical processing, be laterally displaced or folded in relation to the portions 4" of the sealing fin 4 extending over adjacent corner flaps 8. As will be particularly apparent from FIG. 4, the transition from the laterally displaced, central portion 4' of the sealing fin to the portions 4" of the sealing fin running over the corner flaps 8 takes place flush with the transition between the upper surface of the packaging container and the two adjacent corner flaps. Another alternative which, according to the present invention, may be utilized for solving the above-outlined problem is simply to deform or laterally displace a limited portion of the fin, namely at the two transition regions between the upper end surface of the container and the corner flaps. In these transition regions, the fin may preferably be Z-folded or double folded (S-shaped), which entails that this portion of the fin is "buckled" or softened so that in the subsequent reforming of the packaging container, it is relatively flexible and makes it possible to fold the different portions 4', 4" of the sealing fin independently of one another, whereby the stresses in the fin are reduced. In order to facilitate the lateral displacement or Z-folding, the relevant fin portions may be provided with crease lines 9 (FIG. 1) extending transversely over the fin, the crease lines defining the foldable fin portion which has a length which is preferably less than twice the height of the fin.

As will be apparent from FIGS. 1–3, the plastic deformation of the fin preferably takes place in that the transverse sealing fin 4 of the flat-laid packaging container blank is actuated in the desired direction, i.e. both end portions 4" of the sealing fin are preferably left unaffected while the central portion 4' is folded approximately 30° from the original position. In such instance, a flexing of the transition region of the fin takes place, which will plastically or permanently deform the sealing fin in that in particular the fibres of the fibre layer are stretched in an irreversible manner. In the subsequent reforming of the flat-laid packaging container to final form, the "memory" of the packaging material will ensure that the fin portions are folded in the desired manner such that the risk of stresses and damage is reduced. Practical tests have shown that the method according to the present invention makes it possible wholly to obviate leakage and almost entirely avoid the occurrence of microcracks in any layer of aluminium which may possibly be included in the packaging laminate. As a result, the risk of bacterial penetration is reduced, which ensures that the packed product obtains the intended, long shelf-life.

The present invention should not be considered as restricted to that described above and shown on the Drawings, many modifications being conceivable without departing from the scope of the appended Claims.

What is claimed is:

1. A method in the forming of packaging containers which include a sealing fin in which a packaging material is sealed inside-to-inside, and projecting, double-walled corner flaps which are flat-laid, folded down and sealed to an outside surface of the packaging container, said method comprising:

providing a packaging material blank having a sealing fin which extends both over one side of the packaging container and over a corner flap prior to a folding down of the corner flap;

forming a deformation in said sealing fin by laterally displacing at least a portion of the sealing fin in relation to a further portion adjacent to the at least one portion of the sealing fin while said packaging container blank is in a flat, unfolded state, and thereafter, folding the packaging material blank to form the packaging container.

2. The method as claimed in claim 1, wherein the sealing fin includes two end portions and a central portion extending therebetween, the central portion of the fin extending over a container side being laterally displaced in relation to the end portions of the fin extending over the corner flaps.

3. The method as claimed in claim 1, wherein limited portions of the fin are laterally displaced or Z-folded in areas of the fin which are located in transitions between a container side and the corner flaps.

4. The method as claimed in claim 3, wherein said limited fin portions have a length which is less than twice a height of the fin.

5. The method as claimed in claim 3 wherein said limited fin portions are provided with crease lines extending transversely over the fin.

6. The method as claimed in claim 1 wherein the lateral displacement is carried into effect by plastic deformation of the fin prior to folding the packaging material blank to form the packaging container.

7. The method as claimed in claim 1 further comprising folding the packaging material blank to form the packaging container, wherein the corner flaps are folded down and sealed to the outside surface of the packaging container, said folding of the corner flaps stretching the deformation of the sealing fin.

8. A method of forming of a packaging container having a sealing fin in which a packaging material is sealed inside-to-inside and projecting, double-walled corner flaps which are flat-laid, folded down and sealed to an outside surface of the packaging container, said method comprising:

providing a packaging material blank having a sealing fin which extends both over one side of the packaging container and over a corner flap, said sealing fin having a deformation formed by laterally displacing at least a portion of the sealing fin in relation to a further portion of the sealing fin while said packaging container blank is in a flat, unfolded state, prior to folding the packaging material blank to form the packaging container;

thereafter, forming the packaging material blank into an intermediate cushion-shaped configuration of the packaging container wherein the corner flaps extend in a longitudinal direction of the packaging container away from a central region thereof, thereby compressing the deformation of the sealing fin; and thereafter, forming the cushion-shaped container into a final form of the packaging container wherein the corner flaps are folded down and sealed to the outside surface of the packaging container, thereby stretching the deformation of the sealing fin.

* * * * *